US007168196B2

(12) United States Patent
Milliken

(10) Patent No.: US 7,168,196 B2
(45) Date of Patent: Jan. 30, 2007

(54) EXTERNAL ROTARY DEVICE FOR MOUNTING ON A VEHICLE

(76) Inventor: Vincent John Milliken, 1075 Cuesta St., Santa Ynez, CA (US) 93460

( * ) Notice: Subject to any disclaimer, the term of this patent is extended or adjusted under 35 U.S.C. 154(b) by 12 days.

(21) Appl. No.: 10/904,110

(22) Filed: Oct. 23, 2004

(65) Prior Publication Data

US 2006/0086023 A1 Apr. 27, 2006

(51) Int. Cl.
*G09F 21/04* (2006.01)

(52) U.S. Cl. ..... 40/591; 40/440; 40/412; 446/201; 446/217

(58) Field of Classification Search ..... 40/440, 40/412, 413, 479, 538, 591; 446/201, 217; D20/21; 180/309
See application file for complete search history.

(56) References Cited

U.S. PATENT DOCUMENTS 1,421,432 A * 7/1922 Embanks ..... 261/124
1,769,450 A * 7/1930 Morgan ..... 446/201
2,573,625 A * 10/1951 Swart ..... 40/422
4,897,068 A * 1/1990 Jackson ..... 446/217
6,719,085 B2 * 4/2004 Lee ..... 180/309
2004/0221495 A1 * 11/2004 Hogestad ..... 40/421

* cited by examiner

*Primary Examiner*—Gary C. Hoge
(74) *Attorney, Agent, or Firm*—Laura Tunnell

(57) ABSTRACT

The present disclosure relates to a rotary device for external attachment to a vehicle, thereafter being operable for visually attracting attention to all or part of the vehicle, particularly when the vehicle is moving. In the most preferred embodiment, the rotary device attracts the attention of a casual observer via wind-driven rotational motion. In addition to the visual attraction caused by rotational motion, the rotary device can be shaped, decorated and strategically mounted to satisfy the particular attention-getting intent.

1 Claim, 4 Drawing Sheets

EXTERNAL ROTARY DEVICE FOR MOUNTING ON A VEHICLE

BACKGROUND OF THE INVENTION

1. Field of the Invention

The present invention relates to a rotary device for attracting visual attention to a vehicle.

2. Prior Art

The smooth surface of a vehicle is an attractive palette for many things, ranging from the fantastical visions of bodywork artists to the more functional purpose of advertising for a business. However, a flat palette is a static structure and, more often than not, the creative effort spent on its adornment is wasted. In the case of purely artistic designs, the lack of attention results in a mere loss of vanity nourishment. Nevertheless, for more functional purposes such as the advertising of a business, a lack of attention is equivalent to a loss of potential customers and consequently, has a direct bearing on the development and maintenance of a business. The point is driven home if one considers the number of vehicles encountered by an observer during an average day and the fact that rarely do observers remember even a single advertisement. Clearly, there is a need for a means of enhancing visual attraction to advertisements affixed to the side of a vehicle.

SUMMARY

It is an object of the present invention to provide means for enhancing visual attraction to advertisements affixed to the side of a vehicle. This objective is realized by a rotary device adapted for attachment to a vehicle wherein the rotary device spins when the vehicle is in motion. The rotary device comprises a mounting bracket having mounting means operable for attachment of the rotary device to the vehicle, an axle depending from the mounting bracket at a first angle with respect to a horizontal plane, and a solid conical block rotatably mounted on the axle. At least two rotary blades are attached to the solid conical section and lie substantially within an imaginary conical plane defined by a projection of a conical outer surface on the solid conical section.

The features of the invention believed to be novel are set forth with particularity in the appended claims. However the invention itself, both as to organization and method of operation, together with further objects and advantages thereof, may be best understood by reference to the following description taken in conjunction with the accompanying drawings.

DESCRIPTION OF THE PREFERRED EMBODIMENTS

1. BRIEF DESCRIPTION OF THE DRAWINGS

2. IDENTIFICATION OF NUMBERS USED IN THE DRAWINGS

10—vehicle with rotary device of the present invention attached thereto
11—rotary device
12—mounting surface for attachment of rotary device
13—advertisement
20—axle
30—conical assembly
31—phantom conical surface characterizing overall shape of rotary device
32—rotary blades
33—solid conical mounting block
40—mounting bracket
50—cord

3. DESCRIPTION OF THE PREFERRED EMBODIMENTS

Figure 1:
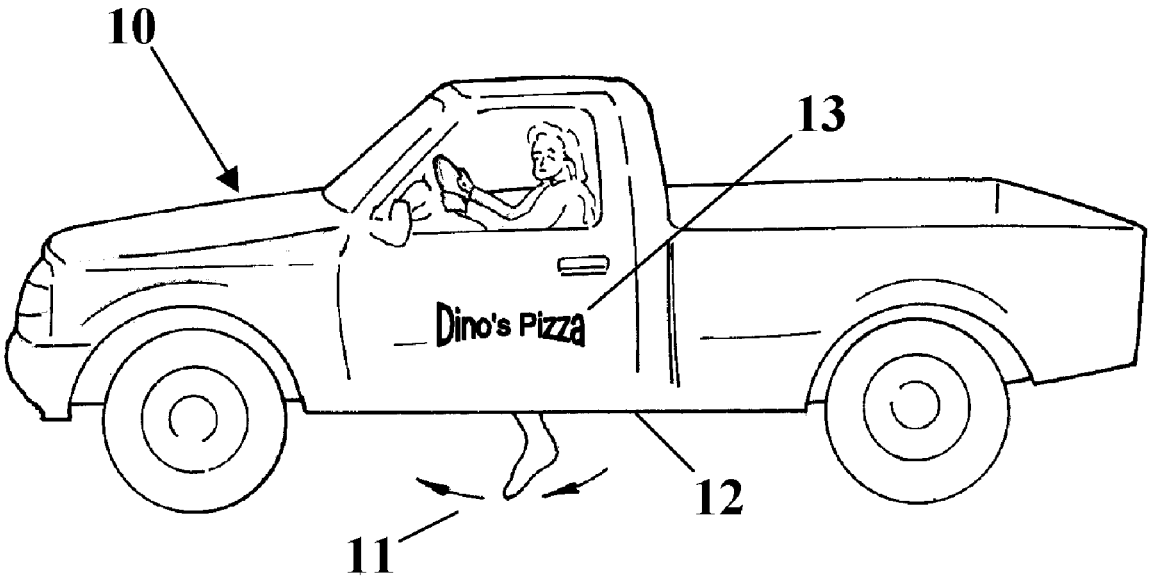
FIG. 1 is a perspective view showing the most preferred embodiment of the present invention.
Figure 2:
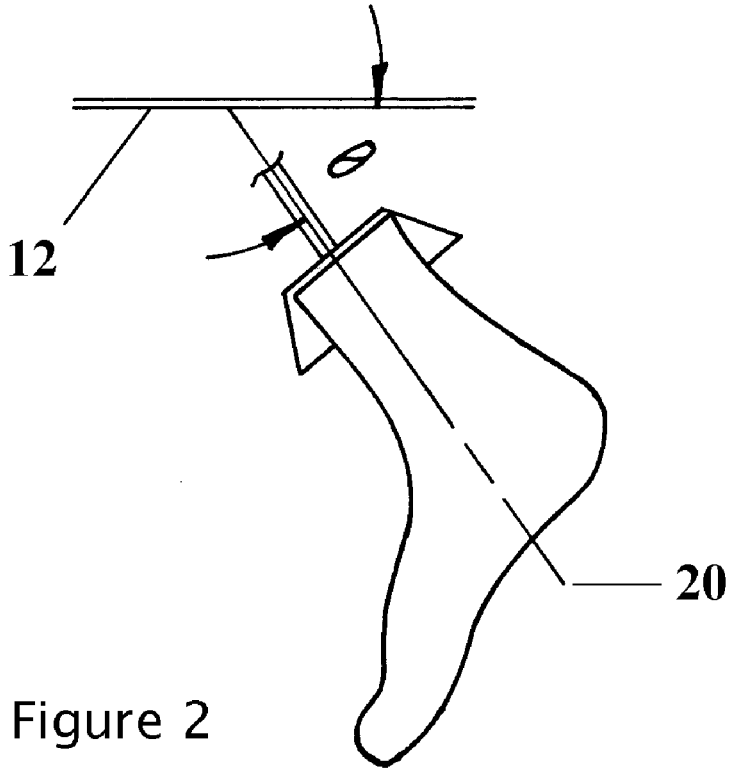
FIG. 2 shows the preferred configuration of the rotary device of the present invention in relation to a horizontal mounting plane of the vehicle.

Turning first to FIG. 1, the rotary device 11 of the present invention is illustrated in its functional environment attached to the underside 12 of a vehicle 10. The rotary device 11 has an axle 20 that provides a physical axis of rotation as indicated in FIG. 2. The axle is tilted at an angle θ with respect to the horizontal plane of the mounting surface of the vehicle underside 12. θ ranges between about 50–60 degrees depending on the clearance available for the rotary device 11 to turn.

Figure 3:
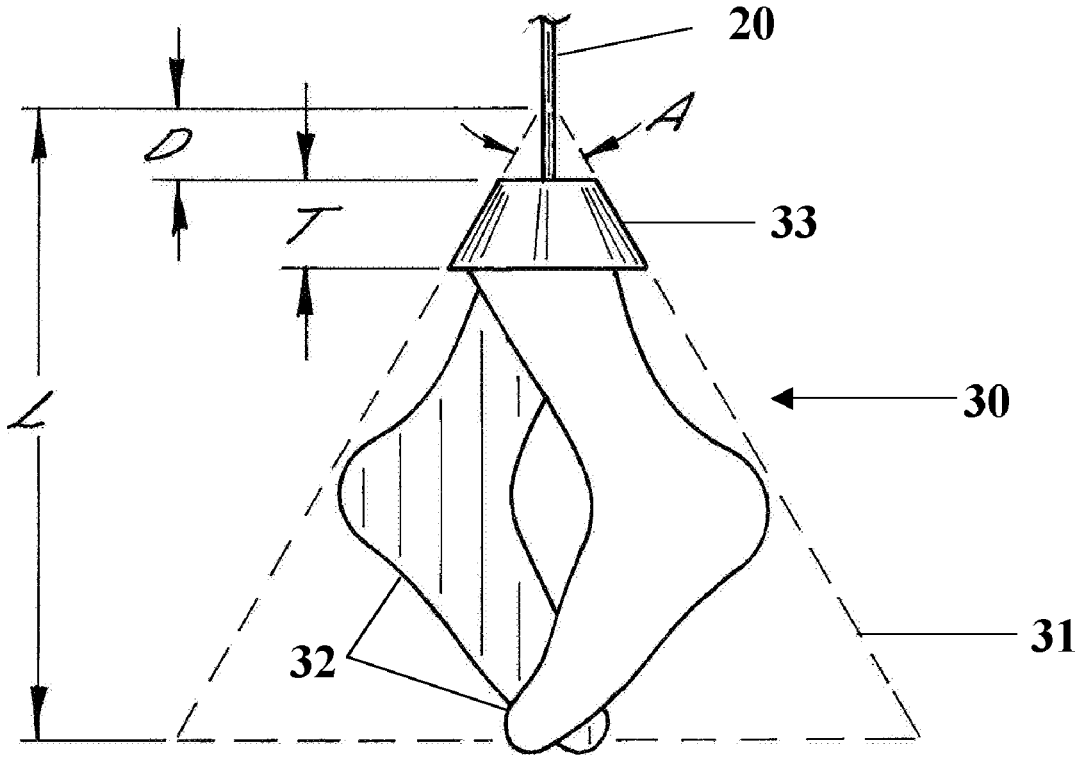
FIG. 3 illustrates the geometrical parameters characterizing the preferred embodiment of the present invention shown in FIGS. 1–2.

The basic geometrical parameters of the rotary device 11 are illustrated in FIG. 3. The rotary device 11 is essentially a hollow conical assembly 30 axially mounted to a bracket 40, shown in FIGS. 4–5, wherein part of the conical surface is shaped to form blades 32, thereby enabling the rotary device to spin when a stream of air impinges thereon. The rotary device 11 comprises a hollow cone 31, shown partially in phantom, having a solid conical mounting block 33. The full angular width A of the cone 31 is between 45 and 90 degrees, preferably about 70 degrees. The length of the conical axis L is approximately 12 to 15 inches long. The solid conical mounting block 33 is shaped like the frustum of a cone and has a thickness T of about 2 to 3 inches. The mounting block 33 is displaced a distance D of about 1 to 2 inches from the apex. The entirety of the conical surface 31 is removed above the solid conical mounting block 33, from the apex to about 1.5 inches. The conical surface 31 below the mounting block 33 is cut and shaped to form the blades 32 of the rotary.

The blades 32 are shaped to form an amusing or otherwise eye-catching contour. In the most preferred embodiment, the blades are configured to resemble the shape of a human foot. Although only two blades are indicated in the drawings, in principle any number can be used subject to the limitations of available space and surface area. The solid conical mounting block 33 provides a support for the blades 32 as well as means for attaching the blades to the axle 20.

Figure 4:
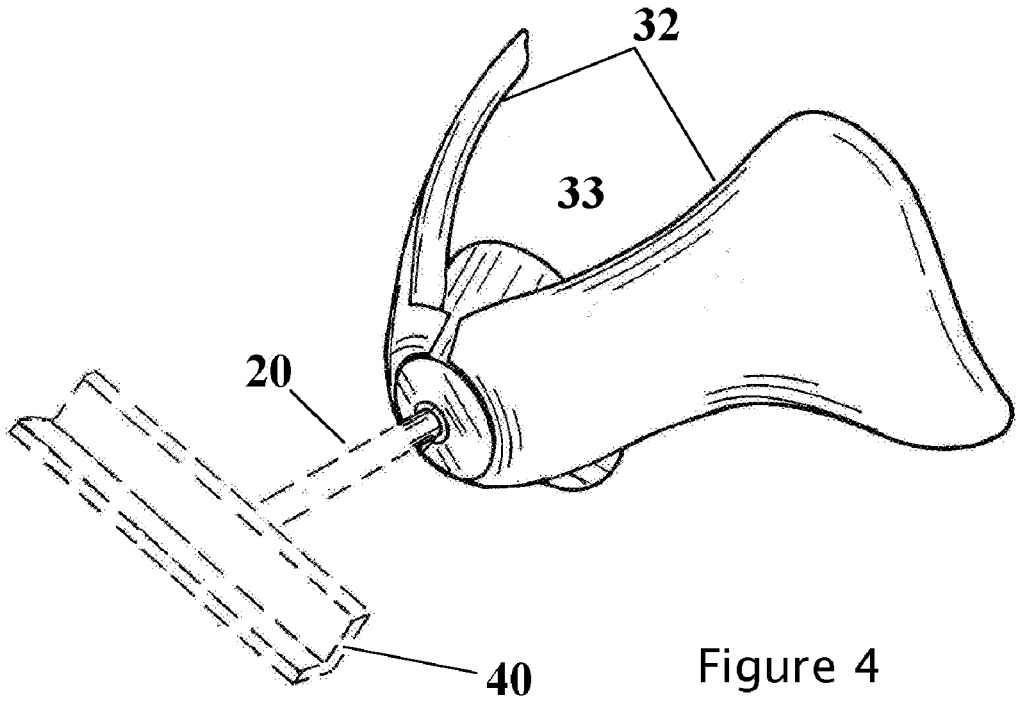
FIG. 4 is a front perspective view of the preferred embodiment of the present invention with the axle and mounting bracket shown in phantom.
Figure 5:
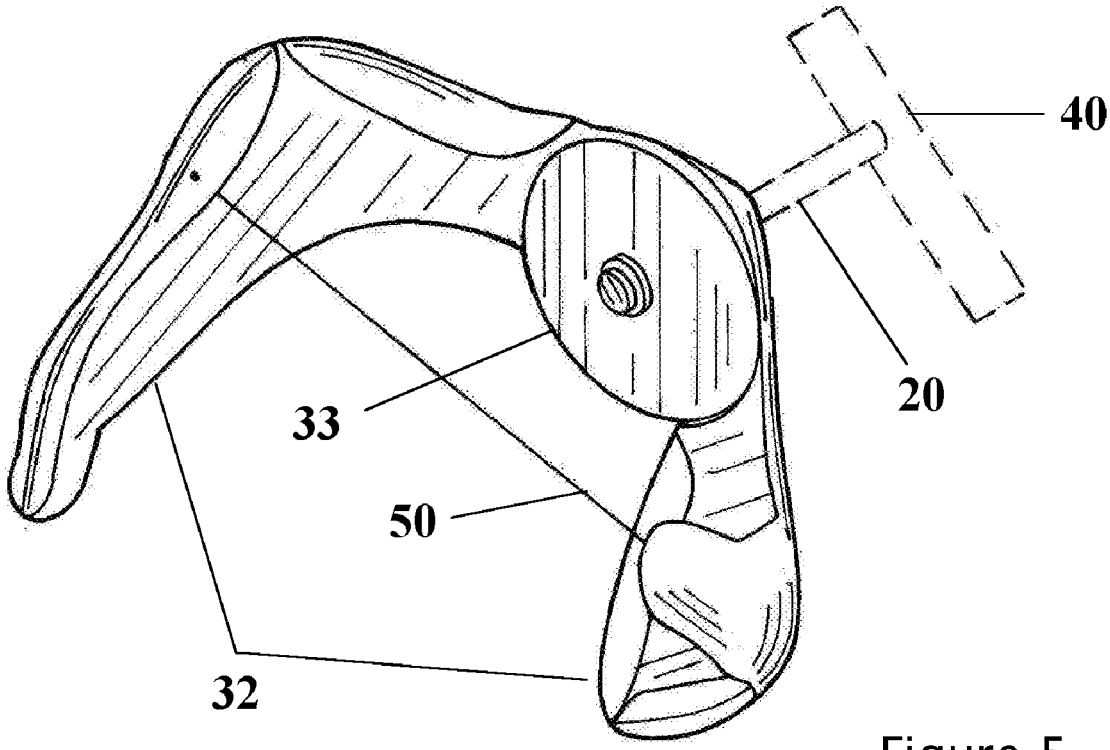
FIG. 5 is a rear perspective view of the preferred embodiment of the present invention shown in FIG. 4.

FIGS. 4–9 show several perspective views of the rotary device 11. The axle 20, solid conical mounting block 33 and rotary blades 32 are commonly indicated in each illustration. Turning now to FIGS. 4–5, the rotary device is shown with the axle and mounting bracket 40 in phantom. The bracket 40 can be attached to the underside 12 of the vehicle using any means necessary to withstand the rigors of road travel such as clamps, adhesives or thumbscrews. The axle can be fixed with respect to the bracket or free to rotate along with the mounting block 33 and attached blades 32. The blades are constructed from a pliable material and, as such, tend to rotate in a plane rather than a cone as their angular frequency increases. Consequently, a compression means such as a light cord 50, is attached to opposing blades in order for the rotary device 11 to retain its approximately conical shape when under the duress of centrifugal forces.

Figure 6:
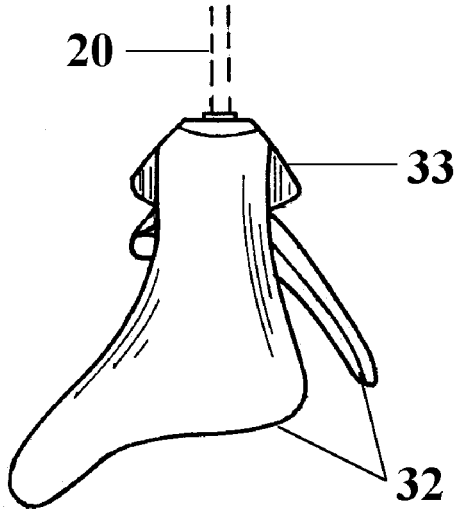
FIG. 6 is a left side view of the preferred embodiment of the present invention illustrated in FIGS. 4 and 5.
Figure 7:
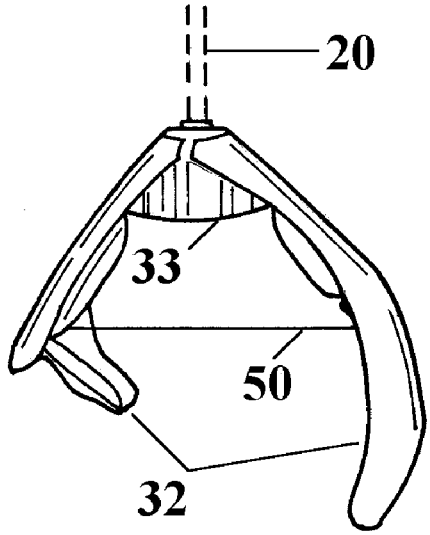
FIG. 7 is a right side view of the preferred embodiment of the present invention.
Figure 8:
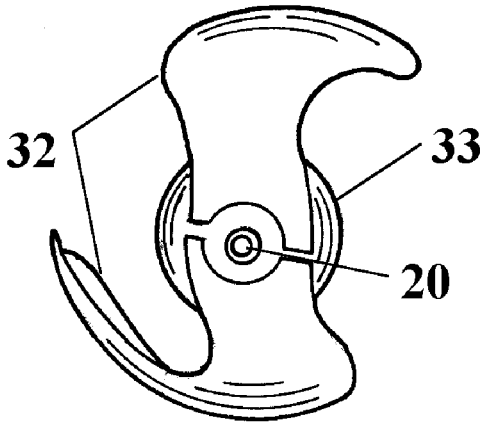
FIG. 8 is a top view of the preferred embodiment of the present invention shown in FIGS. 4–7.
Figure 9:
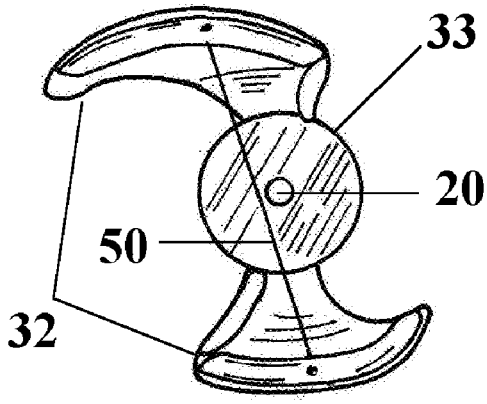
FIG. 9 is a bottom view of the preferred embodiment of the present invention.

FIGS. 6–7 show left and right views of the rotary device 11. The foot shape of the blade is particularly evident in FIG. 6. The relationship of the cord 50 to each of the blade members is again indicated in FIG. 7. FIGS. 8–9 show top and bottom views where the relationship of the solid conical mounting block 33 to the rotary blades 32 is easily seen.

In the most preferred embodiment, the rotary device 11 is mounted to the underside of a vehicle as shown in FIG. 1. The rotary device 11 is located such that it draws attention to a part of the vehicle adorned with advertising 13, such as beneath a door. When the vehicle moves forward, wind driven forces are produced that engage the curved surface of the blades. If the blades are cut to an amusing shape such as human feet, the observer is nudged into a positive frame of mind. Being mentally primed in this manner, the observer's attention is drawn to the advertisement on the vehicle due to its close visual proximity to the rotating rotary device.

In summary, this invention is a rotary device adapted for attachment to a vehicle wherein the rotary device spins when the vehicle is in motion. The rotary device comprises a mounting bracket having vehicle mounting means operable for attachment of the rotary device to the vehicle, an axle depending from the mounting bracket at a first angle with respect to a horizontal plane, and a solid conical block rotatably mounted on the axle. At least two rotary blades are attached to the solid conical section and lie substantially within an imaginary conical plane defined by a projection of a conical outer surface on the solid conical section.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A rotary device for attachment to an underside of a vehicle, said underside of said vehicle having a mounting surface, at least a portion of said mounting surface being in a horizontal plane, said rotary device comprising:

an axle, wherein said axle is tilted at an angle with respect to said horizontal plane, said angle ranging between 50 and 60 degrees;

at least two opposing blades, said opposing blades being flexible and being shaped to resemble human feet;

means for rotatably coupling said at least two opposing blades to said axle;

said at least two opposing blades depending from said means for rotatably coupling at an angle such that said at least two opposing blades form a conical surface of rotation when said at least two opposing blades rotate;

means for applying tension between said at least two opposing blades, wherein said means for applying tension is attached between said at least two opposing blades, and whereby when said at least two opposing blades rotate, said means for applying tension prevents said at least two opposing blades from being deformed by centrifugal forces;

wherein when the vehicle is in motion, said rotary device is disposed in an airsteam, said airstream urging said opposing blades to rotate about said axle, creating the illusion of feet running underneath and propelling said vehicle.

* * * * *